US005692748A

United States Patent [19]

Frisco et al.

[11] Patent Number: 5,692,748

[45] Date of Patent: Dec. 2, 1997

[54] CARD SHUFFLING DEVICE AND METHOD

[75] Inventors: Anthony Frisco, Las Vegas, Nev.; Ferrell Sullivant, Cave Junction, Oreg.

[73] Assignee: Paulson Gaming Supplies, Inc., Las Vegas, Nev.

[21] Appl. No.: 721,795

[22] Filed: Sep. 26, 1996

[51] Int. Cl.[6] ..... A63F 1/12

[52] U.S. Cl. ..... 273/149 R

[58] Field of Search ..... 273/149 R

[56] References Cited

U.S. PATENT DOCUMENTS

| | | |
|---|---|---|
| 2,159,958 | 5/1939 | Sachs . |
| 2,649,305 | 8/1953 | Schoultz . |
| 2,717,782 | 11/1955 | Droll . |
| 2,747,877 | 5/1956 | Howard . |
| 3,305,237 | 2/1967 | Granius . |
| 3,810,112 | 5/1974 | Aho et al. . |
| 3,897,954 | 8/1975 | Erickson et al. . |
| 3,944,230 | 3/1976 | Fineman . |
| 4,310,160 | 1/1982 | Willette et al. . |
| 4,339,134 | 7/1982 | Macheel . |
| 4,397,469 | 8/1983 | Carter, III . |
| 4,421,312 | 12/1983 | Delgado et al. . |
| 4,497,488 | 2/1985 | Plevyak et al. . |
| 4,512,580 | 4/1985 | Matviak . |
| 4,513,969 | 4/1985 | Samsel, Jr. . |
| 4,515,367 | 5/1985 | Howard . |
| 4,586,712 | 5/1986 | Lober et al. . |
| 4,614,342 | 9/1986 | Takashima . |
| 4,659,082 | 4/1987 | Greenberg . |
| 4,667,959 | 5/1987 | Pfeiffer et al. . |
| 4,770,421 | 9/1988 | Hoffman . |
| 4,805,909 | 2/1989 | Roland . |
| 4,807,884 | 2/1989 | Breeding . |
| 4,832,342 | 5/1989 | Plevyak et al. . |
| 4,969,648 | 11/1990 | Hollinger et al. . |
| 5,000,453 | 3/1991 | Stevens et al. ..... 273/149 R |
| 5,096,197 | 3/1992 | Embury . |
| 5,120,939 | 6/1992 | Claus et al. . |
| 5,226,664 | 7/1993 | Bodkin, Sr. . |
| 5,240,140 | 8/1993 | Huen . |
| 5,248,142 | 9/1993 | Breeding . |
| 5,261,667 | 11/1993 | Breeding . |
| 5,275,411 | 1/1994 | Breeding . |
| 5,288,081 | 2/1994 | Breeding . |
| 5,289,542 | 2/1994 | Kessler . |
| 5,303,921 | 4/1994 | Breeding . |
| 5,344,146 | 9/1994 | Lee . |
| 5,356,145 | 10/1994 | Veschoor . |
| 5,382,024 | 1/1995 | Blaha . |
| 5,397,128 | 3/1995 | Hesse et al. . |
| 5,417,430 | 5/1995 | Breeding . |
| 5,431,399 | 7/1995 | Kelley . |
| 5,431,407 | 7/1995 | Hofberg et al. . |
| 5,437,462 | 8/1995 | Breeding . |
| 5,445,377 | 8/1995 | Steinbach . |

FOREIGN PATENT DOCUMENTS

| | | | |
|---|---|---|---|
| 421267 | 10/1910 | France | 273/149 |
| 671494 | 1/1939 | Germany | 273/149 |

*Primary Examiner*—William M. Pierce
*Attorney, Agent, or Firm*—Quirk & Tratos

[57] ABSTRACT

A device and method are set forth for shuffling a stack of N cards. The stack is positioned at a cutting station where the card stack is cut into unequal portions (N/2)−A and (N/2)+A. The cards from each portion are then deposited in an interleaving fashion. The additional quantity of cards A of one of the portions is transported from proximate the center of the stack N to the top of the shuffled stack. Further cutting and interleaving randomly distributes the cards in the stack.

35 Claims, 8 Drawing Sheets

CARD SHUFFLING DEVICE AND METHOD

FIELD OF THE INVENTION

The present invention relates to devices and methods for shuffling cards.

BACKGROUND OF THE INVENTION

In card games of chance involving wagers such as in the game of Blackjack, it is desirable to obtain, through shuffling of the cards, a random and unpredictable distribution of the cards. Unless the cards are shuffled to obtain the desired random distribution, players may be able to predict opportunities when a winning hand is more likely to be dealt. When those opportunities are predicted, the player can increase his/her wager. If such predictions can be made with accuracy and frequency, a player can achieve significant success and the casino hosting the Blackjack game experience significant losses.

Thus, when shuffling a single deck of cards, the dealer typically "strips" the deck by moving cards in groups into different relative positions in the deck along with interleaving the cards. This stripping action is important since simple interleaving may not significantly shift the relative positions of the cards in the deck. Simply multiple interleaving may not transport cards in the deck to obtain the desired randomness. Hence, by stripping, significant mobility of the cards is obtained which promotes a random and unpredictable distribution of cards throughout the deck.

Also related to shuffling, where multiple decks of cards, e.g. two to six decks, are being dealt from a shoe, hand shuffling is time consuming. The amount of time necessary for the dealer to assemble the cards, separate them into smaller manageable portions for hand stripping and interleaving and repetition of this process, not only reduces the time during which the game is being played, but the delay during shuffling may also cause players to leave the table. Further, since the multiple deck stack must be broken apart into manageable portions, stripping and interleaving may be insufficient to obtain a random and unpredictable distribution of cards throughout the multiple deck.

Shuffling devices have been devised to relieve the dealer of the time consuming shuffling operation. However, these devices are complicated and do not provide significant card transportation, i.e. stripping, to assure random and unpredictable distribution of cards throughout the card stack.

SUMMARY OF THE INVENTION

This is, therefore, a need for a device and method for shuffling a stack of cards which provides for significant transportation of cards in the stack to obtain randomness and unpredictability and which can quickly shuffle from two to six or more decks of cards.

Toward this end, a device for shuffling playing cards is provided which includes a platform to support a stack of playing cards which may comprise two to six or more decks. Means are provided for moving the platform to position the stack at a cutting and shuffling station in the device. At the cutting and shuffling station, a sweep cuts and separates the card stack into two unequal portions. Thereafter suitable means interleave the cards from the separated portions into a shuffled stack. Because the stack is cut into unequal portions, a group of cards is transported from approximately the middle of the original stack to the top of the stack to accomplish the desired stripping.

A method, according to the present invention, for shuffling a stack of N cards includes positioning the stack at a cutting station. The stack is then cut by moving a first portion having (N/2)−A cards to one location and a second, remaining quantity of cards (N/2)+A cards to another location, the quantity of cards A representing a quantity of cards striped from proximate the center of the stack. The method further includes interleaving the cards from the first and second stack portions in substantially alternating fashion, the quantity of A cards deposited on top of the shuffled stack. Accordingly the method results in the transportation of the quantity of cards A from proximate the middle of the stack to the top of the shuffled stack.

Repeated shuffling with the device and according to the method of the present invention, results in the random and unpredictable distribution of cards in the stack. Furthermore, the shuffling is done quickly and automatically reducing the amount of time that the gaming table is not in play and relieving the dealer of the manual task of shuffling.

BRIEF DESCRIPTION OF THE DRAWINGS

These and other features and advantages will become appreciated as the same becomes better understood with reference to the specification, claims and drawings wherein:

DESCRIPTION

Figure 1:
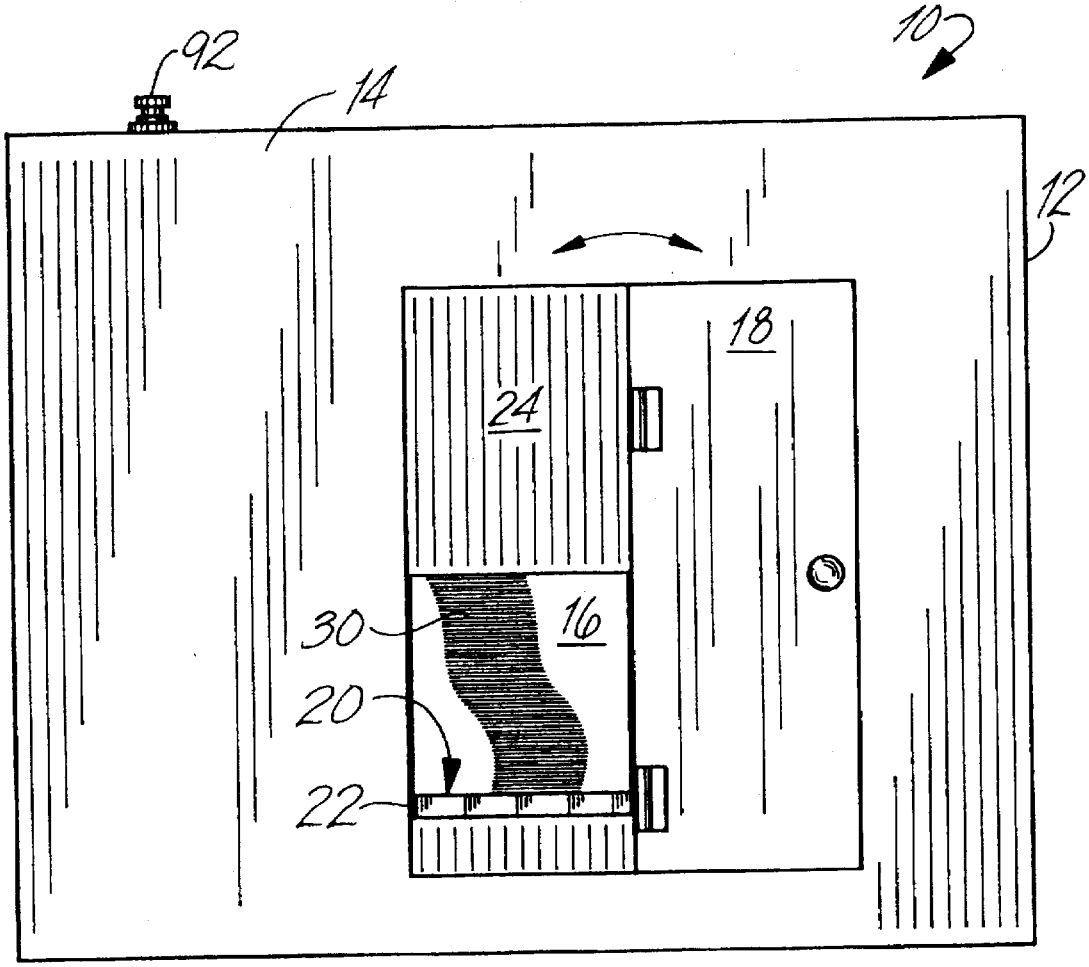
FIG. 1 is a front view of the device according to the present invention.

With reference to the drawings, FIG. 1 shows the device 10 according to the present invention which includes a housing 12 adapted to contain the components hereinafter described. The device 10 is adapted to be portable and sit on a gaming table, such as a Blackjack table. The device 10 receives power from an outside power source through a power plug (not shown) in a well known fashion. While the housing 12, as illustrated herein, is shown as being generally rectangular, it is to be understood that it could have any suitable shape.

The housing 12 has opaque or semi-transparent walls 14, such as being fashioned from smoked glass or acrylic, to block a significant amount of light from entering the housing 12. To provide access for inserting a card stack 16 into the housing 12 for shuffling and for removing a shuffled stack, a door 18 is hingably coupled to the housing 12. The door 18 is transparent in that many jurisdictions which regulate gaming require the shuffling to be done in view of the players.

The card stack 16 may be anywhere from two to six or more decks of playing cards. Typically shoes from which cards are dealt during the play of a casino game are loaded with six or more decks for dealing. The stack 16 consists of a number of cards N. For most games N equals the number of decks times 52 cards per deck.

Figure 2:
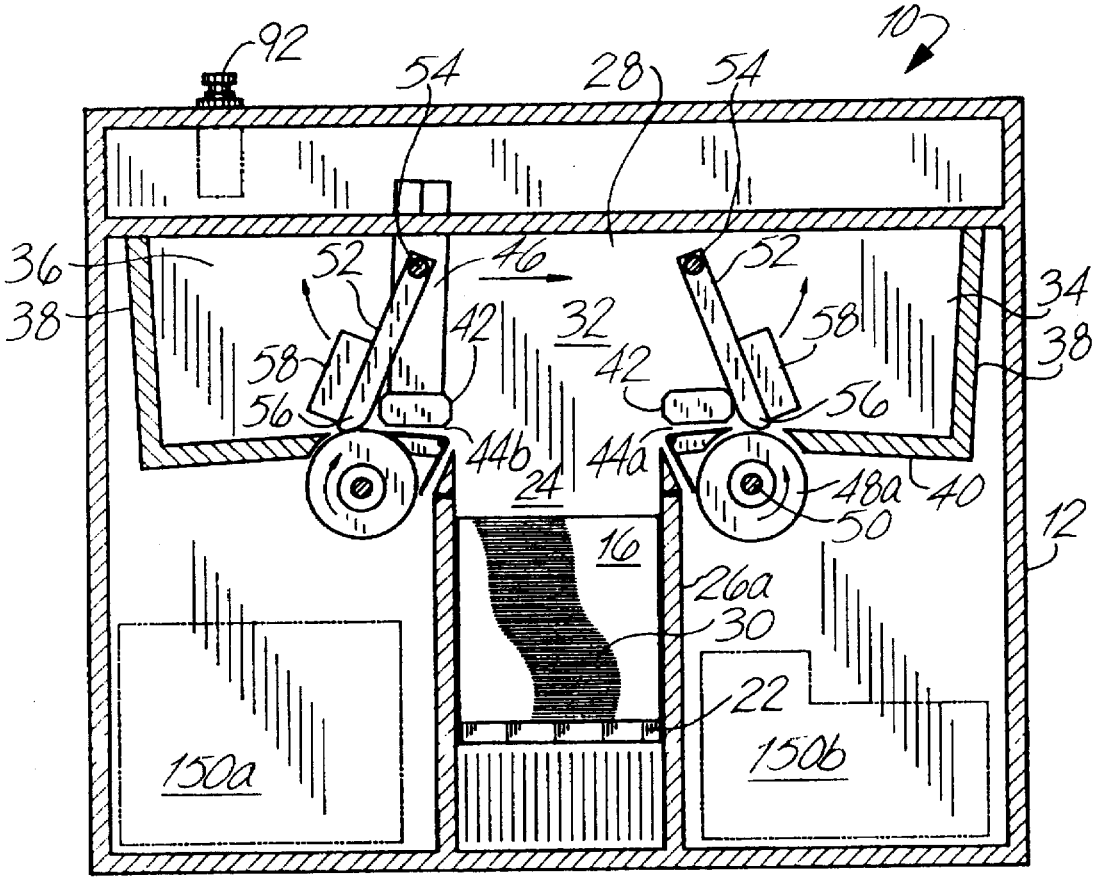
FIG. 2 is a front view of the device according to the present invention illustrating the components therein.
Figure 4A:
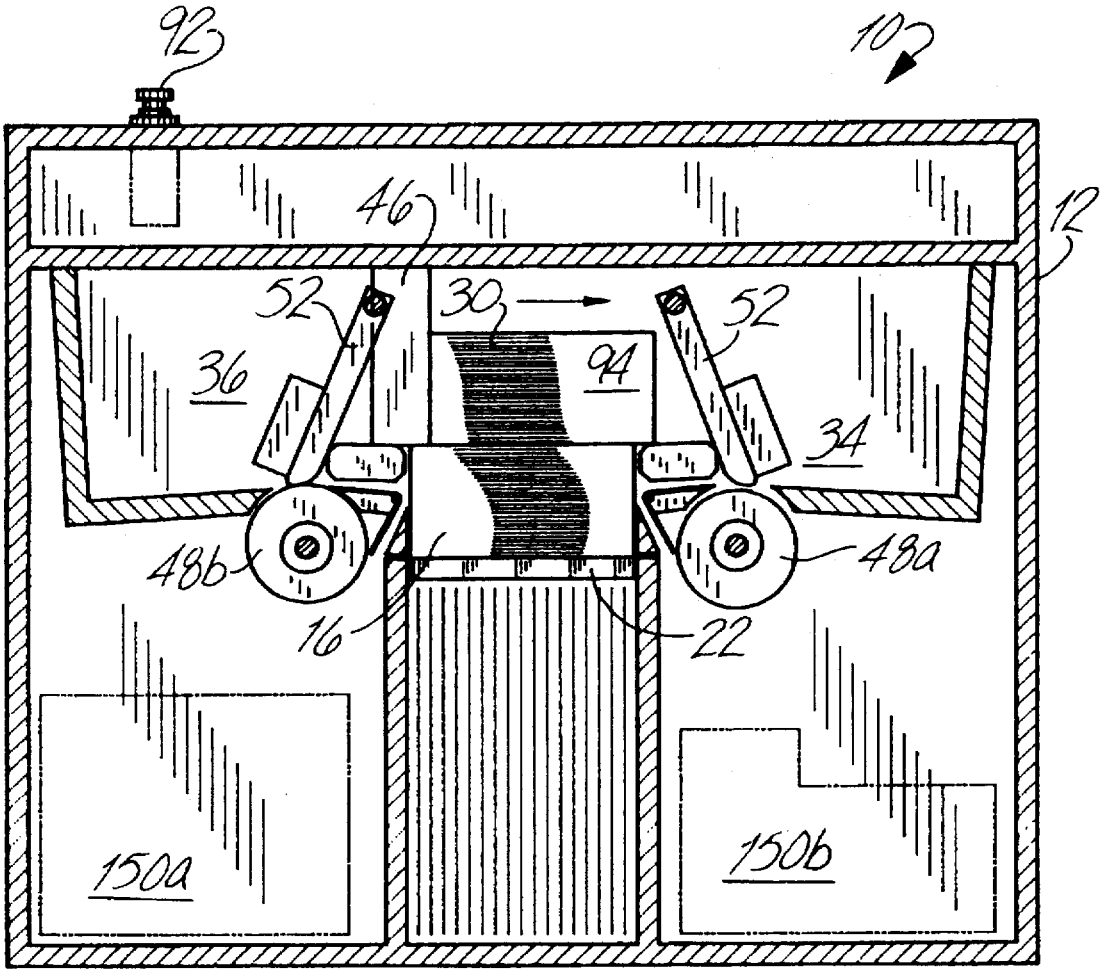
FIGS. 4*a* through 4*d* are front views of the device similar to that of FIG. 2 illustrating the operation of the device and method of present invention.

To position the stack 16 for shuffling according to the present invention, an elevator 20 having a platform 22 is provided. When the stack 16 is placed into the device through the door 18, the stack is placed on top of the platform 22 as illustrated in FIGS. 1, 2 and 4*a*. As hereinafter described, the platform 22 is controlled for a vertical movement within the housing 12.

To accommodate the elevator platform 22 and as shown in FIG. 2, the elevator shaft 24 is defined by side walls 26*a,b* in the housing 12, a rear wall 28 and the door 18. The dimensions of the shaft 24 defined by the side walls 26*a,b*, rear wall 28 and door 18 are such to receive and arrange the cards 30 of stacks 16 in a stacked fashion as illustrated. The shaft 24 terminates at its upper end at a shuffling station 32, the purposes of which will hereinafter become evident. Accordingly within the shaft 24, the platform 22 is moved from a lowered position as shown in FIG. 2 to a raised position to move the stack 16 to the shuffling station 32.

At the shuffling station 32 and proximate the upper terminus of the shaft 24 are first and second chambers 34, 36. As illustrated in FIG. 2, the first and second chambers 34, 36 are positioned, when the device 10 is viewed from the front, to the right and left, respectively, of the shaft 24. It is to be understood that the position of the first and second chambers 34, 36 could be reversed with respect to the shaft 24.

Each of the first and second chambers 34, 36 has side walls (not shown), a rear barrier 38 and a floor 40. The chambers defined by the side walls, rear barrier 38 and floors 40 are dimensioned to receive, nest and support cards 30. The floor 40, opposite the rear barrier 38, terminates at the shaft 24 and is declined therefrom to receive and nest cards 30 deposited therein as hereinafter described.

Where each of the floors 40 terminates at the shaft 24, a front barrier 42 is secured within the housing above the floor 40 to define first and second chutes 44*a,b* adapted to pass a playing card from the respective chambers into the shaft 24.

To cut the stack 16 of cards 30, a vertically disposed, horizontally translatable sweep 46 is provided. As illustrated in FIGS. 4*a*, 4*b*, the sweep is controlled and driven to move between a first position where it is located above the front barrier 42 of the second chamber 36 to a second position where it is located above the front barrier 42 of the first chamber 34. For this purpose, the sweep 46 is secured to a toothed rack (FIG. 3) mounted for translation by suitable means such as a cooperating channel or race. Other methods to provide for the translation of the sweep 46 between its first and second positions may be employed to effect the cutting of the card stack 16 in the manner hereinafter described.

To interleave the cards, the device 10 includes a tractive element associated with each of the first and second chambers 34, 36 and adapted to frictionaly engage and eject a card through respective chutes 44*a,b* into the shaft 24. The tractive elements may be driven belts, but, preferably for this purpose, the device 10 includes pairs of wheels 48*a ,b* disposed proximate the chutes 44*a,b* at the floors 40 of the first and second chambers 34, 36. Each wheel (only one wheel of each pair shown in the drawings) is eccentrically mounted on a driven axle 50 and has a circumference such that at least a portion during rotation contacts cards disposed in the respective first and second chambers 34, 36. Preferably the eccentric mounting of the wheels on their respective axles 50 is such that the wheels 48*a,b* of each pair is in contact with a card during approximately one half, i.e. 180 degrees of its rotation. For purposes which will hereinafter become evident, the contact of the wheels 48*a* with cards are 180 degrees out of phase with that of wheels 48*b*. That is, when the pair of wheels 48*a* of the first chamber 34 is in contact with a card, the other pair of wheels 48*b* is out of contact with cards in the second chamber 36. Similarly, when the pair of wheels 48*b* associated with the second chamber 36 are in contact with a card, the pair of wheels 48*a* associated with the first chamber 34 are out of contact. In this fashion, as described below, cards are pulled and ejected through the chutes 44*a,b* in alternating fashion from the first and second chambers 34, 36.

To assure traction between the wheels 48*a,b*, the circumference thereof has a coefficient friction to engage and pull a card, transport it and ejected it from the respective chutes 44*a,b* into the shaft 24.

While preferably pairs of wheels 48*a,b* are used, it is to be understood that a single wheel or a cylinder could also be used as the tractive element.

To impose a load on cards 30 deposited in the first and second chambers 34, 36 to assure traction with the wheels 48*a,b*, means are provided to vertically load the cards and urge them against the floors 40. For this purpose, each of the first and second chambers 34, 36 has an arm 52 pivotly mounted at one end by a pivot 54 to the housing 12 and having at the other end a foot 56. As described hereinafter, when cards are cut and deposited into the first and second chambers 34, 36, the arms 52 pivot as the cards 30 are urged over the front barriers 42 into their nested positions in the first and second chambers 34, 36. As nested on the floors 40 of the first and second chambers 34, 36, the arms remain in contact with the top of the cards 30 to impose a vertical load on the cards 30 to urge them to be contacted by the wheels 48*a,b*. Proximate the foot 56 of each arm 52, a weight 58 is provided on each of the arms 52. While a single arm 52 is shown it is to be understood that a pair of such arms 52 could be used at each of the chambers.

Figure 3:
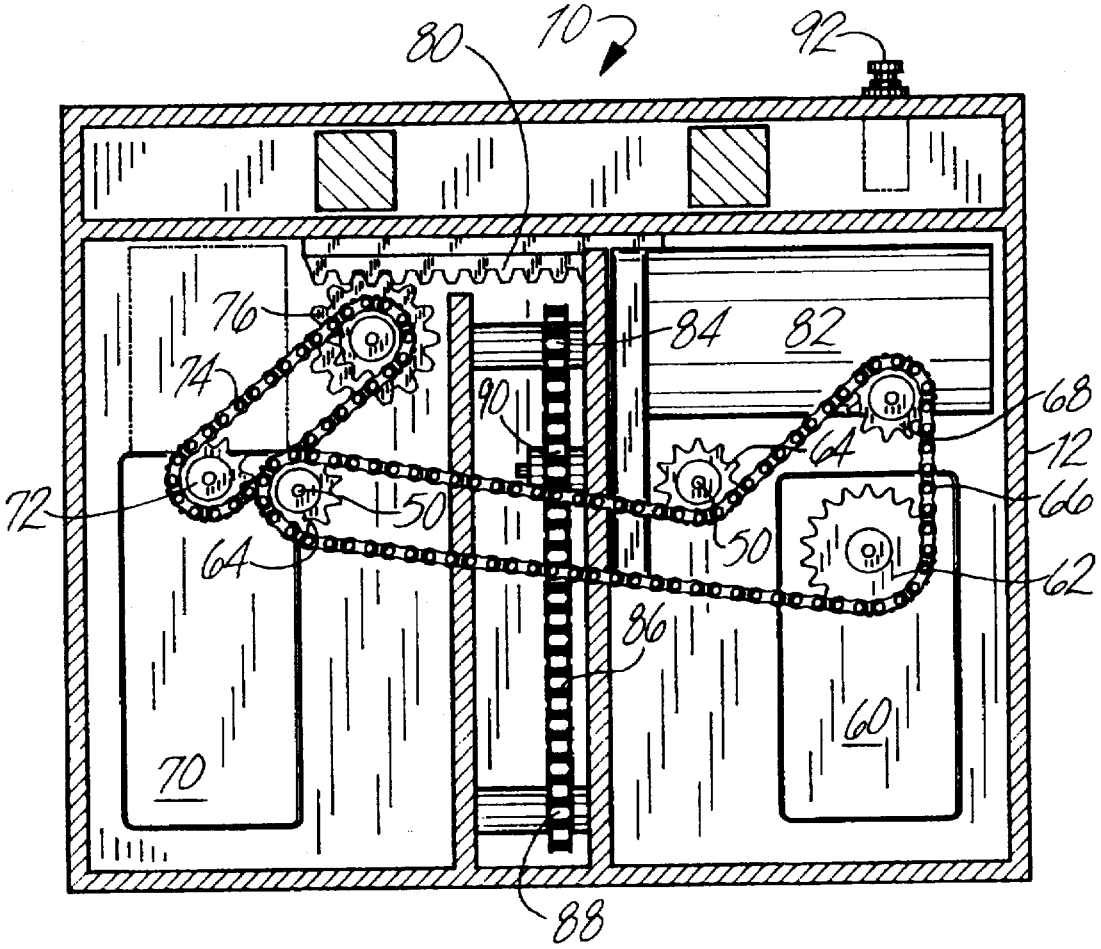
FIG. 3 is a rear view of the device according to the present invention illustrating the components therein.
Figure 4B:
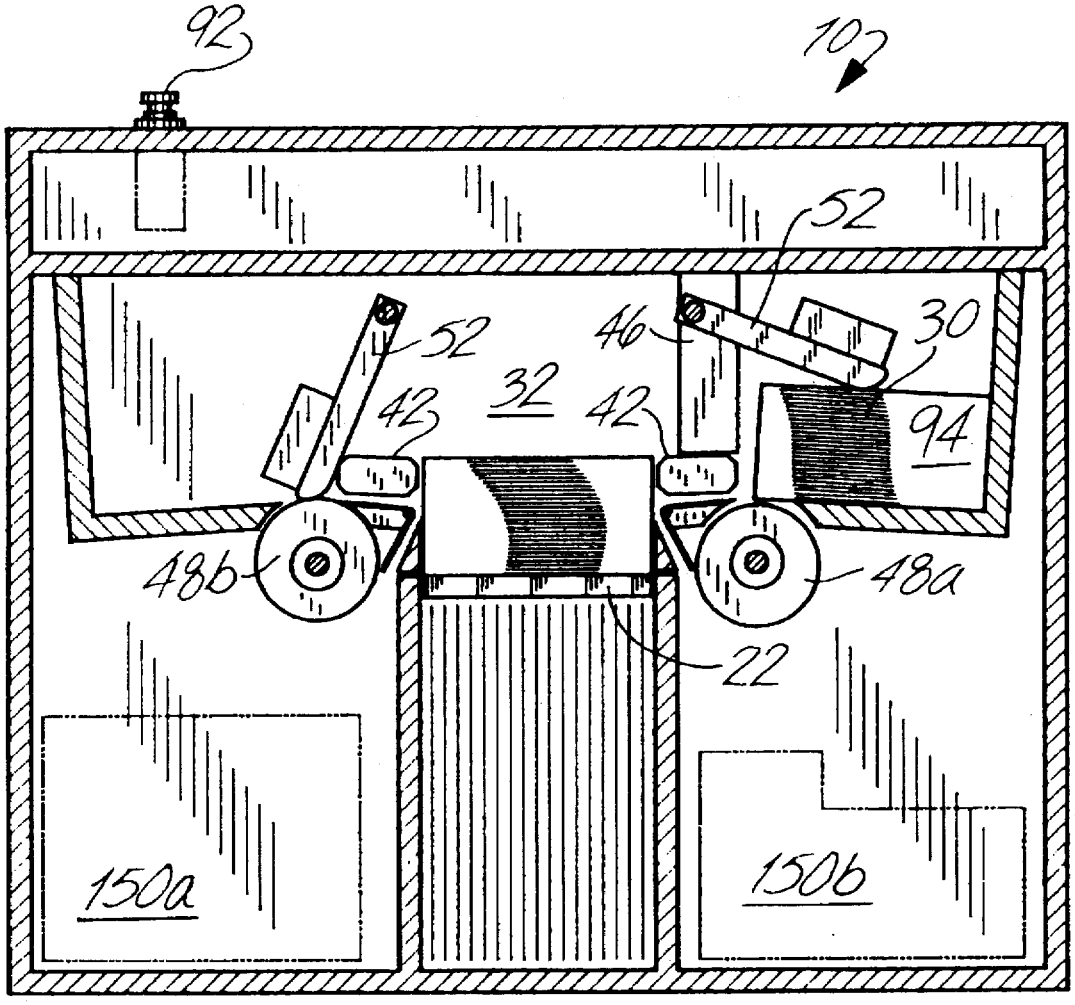

With reference to FIG. 3, to drive and control the elements of the device, suitable means are provided. Accordingly, to drive the pairs of wheels 48*a,b*, the device 10 includes an electrically powered wheel drive motor 60, the output shaft of which is connected to a wheel drive sprocket 62. Each of the axles 50 has mounted thereon wheel driven sprockets 64, driven by an endless wheel drive chain 66, meshing with the wheel drive sprocket 62 and wheel driven sprockets 64. A wheel drive idler sprocket 68 journaled to the housing 12 completes the path of the wheel drive chain 66 for meshing engagement with the wheel driven sprockets 64*a,b*. As can be appreciated, powering the wheel drive motor 60 drives the wheel drive chain 66 which rotates the pair of wheels 48*a* in a counter clockwise direction and the pair of wheels 48*b* in a clockwise direction as illustrated in FIG. 2. These wheels 48*a,b* may be driven at any suitable speed and a speed of 312 rpm has been found sufficient for the purposes of this invention.

To provide for the translation of the sweep 46, the device 10 includes an electric, reversible sweep drive motor 70 disposed within the housing 12. A sweep drive sprocket 72 is coupled to the output of the sweep drive motor 70 to drive a sweep drive chain 74. The sweep drive chain 72 is, in turn, disposed about and meshes with a sweep driven sprocket 76 rotatably fixed and journaled within the housing 12 in a known fashion. Coupled to the shaft of the sweep driven sprocket 76 for rotation therewith is a sweep drive pinion 78 which, in turn, meshes with a sweep drive rack 80 which has the sweep 46 coupled thereto. The sweep drive rack 80 is disposed for translation within the housing 12 by suitable means such as a cooperating channel or race (not shown). Accordingly, drive of the sweep drive motor 70 results in horizontal translation of the sweep 46 between the aforesaid first and second positions.

To provide for the raising and lowering of the elevator platform 22, the device 10 also includes an elevator drive motor 82. The output of the elevator drive motor 82 is provided to an elevator drive sprocket 84 which in turn meshes with an elevator drive chain 86. Below the elevator drive sprocket 84, is located a first elevator drive idler sprocket 88. A second elevator drive idler sprocket 90 is journalled within the housing 12 and is offset with respect to the elevator drive sprocket 82 and first elevator drive idler sprocket 88 and meshes with the elevator drive chain 86 to complete the path thereof. The elevator platform 22 is coupled to the elevator drive chain 86 between the elevator drive sprocket 84 and the first elevator idler sprocket 88. Accordingly it can be appreciated that operation of the elevator drive motor 82 in forward and reverse directions, drives the elevator drive chain 86 to guide, raise and lower the platform 22 within the shaft 24.

With the components of the device 10 having been described, the operation of the device 10 will now be set forth.

To shuffle a stack of cards, the dealer opens the door 18 and places the stack 16 on the platform 22. The dealer closes the door 18 and initiates the shuffling of stack by, for example, depressing an on/off button 92. Initiation of the shuffling causes the controllers shown collectively as 150*a,b* to power the elevator drive motor 82 to elevate the platform 22 to a first position at the cutting and shuffling station 32 as shown in FIG. 4*a*. Optical sensors (not shown) in communication with the controllers 150*a,b* are used to control the positioning of the platform 22. At this position, the controller disengages the drive of the elevator drive motor 82 and initiates the drive of the sweep drive motor 70. Initiation of the drive in a first direction urges the sweep 46 from its first position located over the front barrier 42 of the second chamber 36 toward its second position which, as illustrated in FIG. 4*a*, urges a first portion 94 of the stack 16 to pass over the front barrier 42 of the first chamber 34 to nest into the first chamber 34. When the first portion 94 has been deposited into the first chamber 34 as illustrated in FIG. 4*b*, the sweep 46 is located over the front barrier 42 of the first chamber 34 and the arm 52 has pivoted to accommodate the aforesaid deposit. Furthermore, the arm 52 provides a load upon the first portion 94 of cards 30.

Figure 4C:
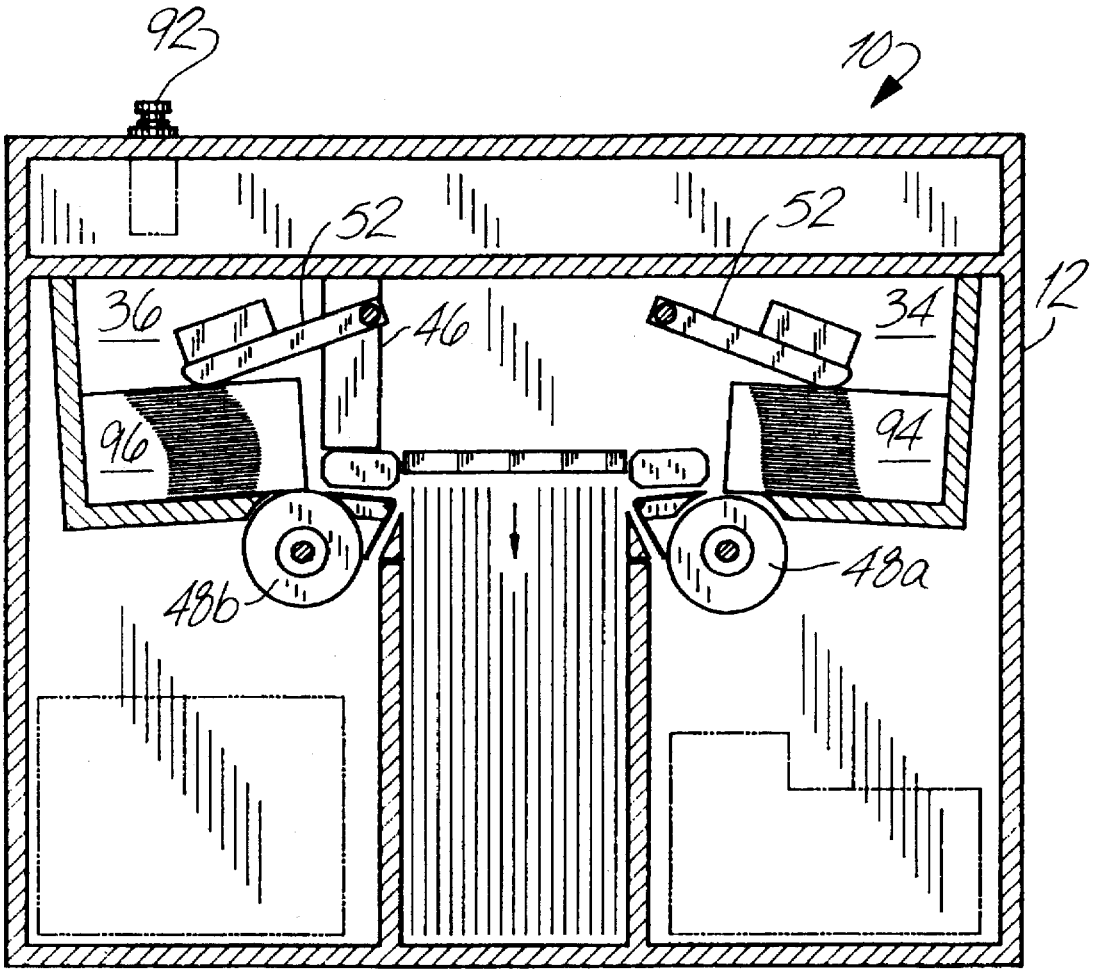

After the first portion 94 has been deposited into the first chamber 34, the elevator drive motor 82 is re-engaged to raise the platform 22 to a second position shown in FIG. 4*c* and stop. Thereafter the sweep drive motor 70 is driven in reverse direction to translate the sweep 46 in reverse direction to deposit the remaining, second portion 96 of the stack of cards 30 over the front barrier 42 of the second chamber 36 to nest therein as illustrated. As described above, the pivoting of the arm 52 accommodates the deposit of the second portion 96 into the second chamber 36 and the arm 52 provides a vertical load on the cards 30 of the stack second portion 96.

To provide for the stripping action, the indexing of the platform 22 by the drive of the elevator drive motor 82 is such as to divide the stack into unequal first and second portions 94 and 96. Where the stack includes N number of cards, for which in most games N equals the number of decks time 52 cards per deck, the first stack portion includes (N/2)−A cards whereas the second portion 96 includes (N/2)+A cards where A represents the additional quantity of cards 30 deposited into the second chamber 36 as the top of stack portion 96. For example, where four decks of cards comprise the stack 16, N equals 208 cards and A may be from 7 to 10 cards. Thus, in this example, the first portion 94 of cards would include 94 to 97 cards whereas the second portion 96 of cards would include 111 to 114 cards. This unequal cutting of the stacks 16, as described, results in a stripping action beneficial to the random and unpredictable distribution of cards when shuffling is completed.

Figure 4D:
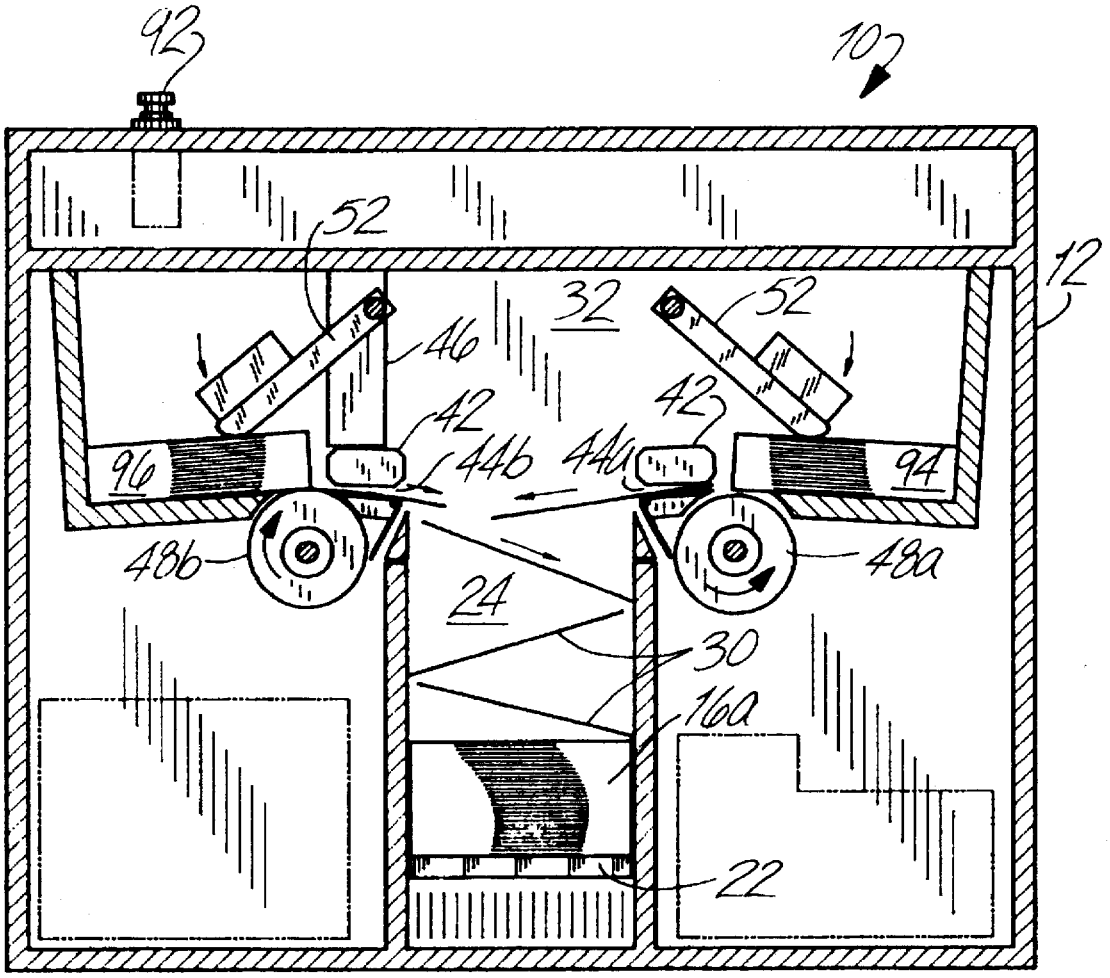

After cutting the stack 16 in the manner described above, into the first and second portions 94 and 96, the controller reverses the elevator drive motor 82 to lower the platform 22 to its initial position and energizes the wheel drive motor 60. As illustrated in FIG. 4*d*, drive of the pairs of wheels 48*a,b* by the wheel drive motor 60 pulls cards from the bottom of each of the first and second portions 94, 96 and ejects them through their respective chutes 44*a,b* into the shaft 24 where they fall and restack onto the platform 22. The 180 degree offset of the eccentricities of the pairs of wheels 48*a,b* cause the cards to be alternatively ejected from the first and second chambers 34, 36 to interleave as they fall into the shaft and restack onto the platform 22. Preferably, the dimensions of the chutes 44*a,b*, angular velocity of the wheels 48*a,b* and the coefficient of friction provided by the wheels 48*a,b* are selected to eject cards one at a time. Thus, the cards are individually restacked in alternating fashions from the first and second portions 94, 96 onto the platform 22.

Because additional cards have been included in the second portion 96 deposited in the second chamber 36, these cards are ejected into the shaft 24 to restack as a group on top of the now shuffled stack 16*a*. Thus, these cards, which previously occupied a location proximate the center of the stack 16 are, in effect, stripped since they have been transported by the cutting and interleaving to a position on top of the shuffled stack 16*a*.

Once the stack 16*a* has been shuffled, the wheel drive motor 60 is deenergized and the elevator drive motor 80 reengages to return the stack 16*a* to the shuffling station 32 for recutting and reshuffling. This sequence is repeating, preferably, five or more times to obtain a random and unpredictable distribution of cards in the shuffled stack.

After shuffling has been completed by either a timed or counting of sequences, no further shuffling is required and the controllers 150*a,b* deenergize motors and resets for the next following shuffling sequence. At this time, the dealer opens the door 18 and removes the shuffled stack 16, permits a player to cut the stack, if desired, and places the stack 16 in a shoe for dealing.

Figure 5:
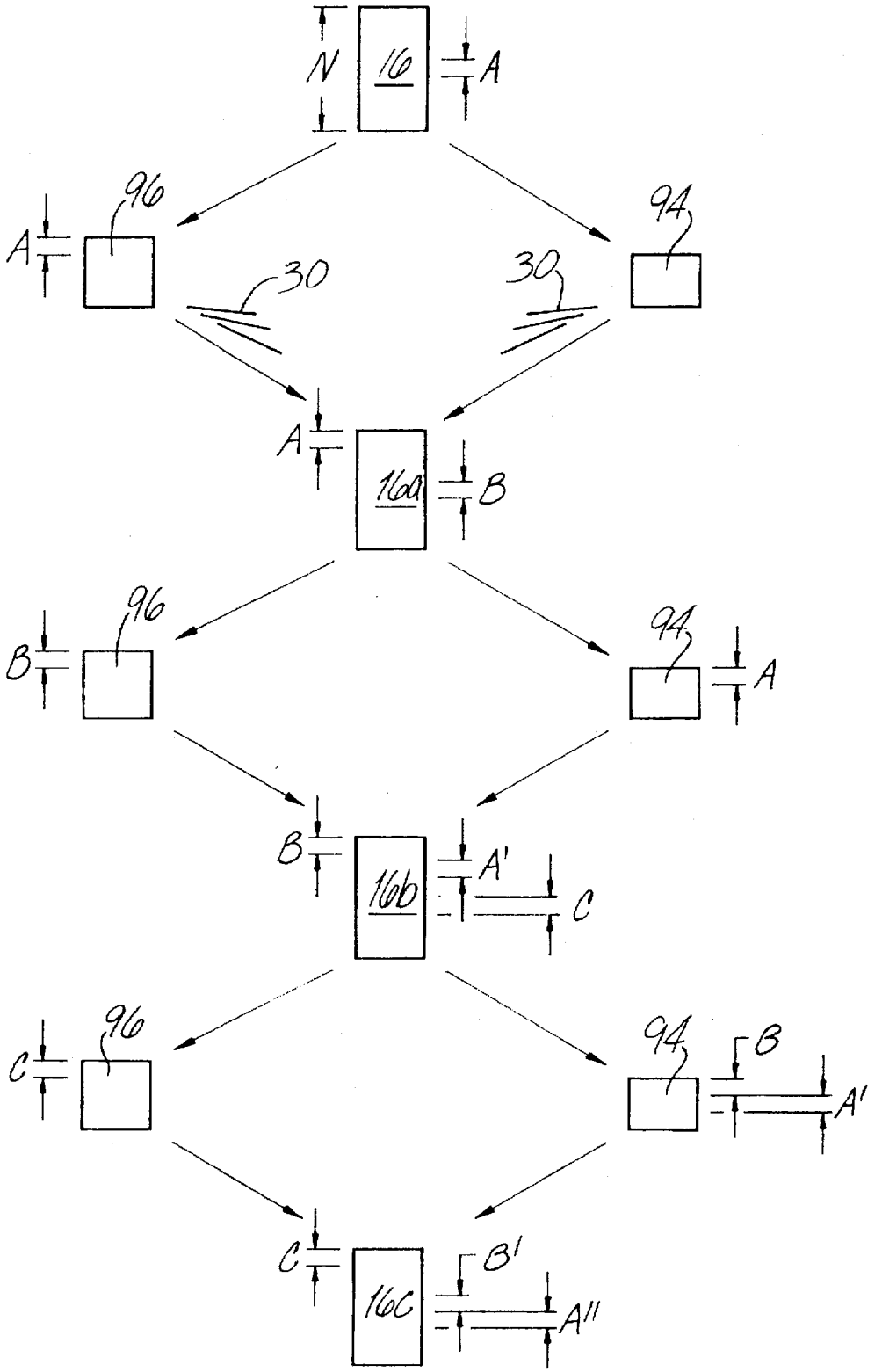
FIG. 5 graphically illustrates the shuffling and stripping according to the device and method of the present invention.

With reference to FIG. 5, the stripping and transportation of cards by the device and according to the method of the present invention is graphically illustrated. As illustrated on the top of FIG. 5, the stack 16 comprises a number of cards N. Proximate the middle of the stack 16 is a segment or group of cards A which, according to the device and method of the present invention, is stripped and transported during shuffling. At the shuffling station 32, the stack 16 is divided into unequal first and second stack portions 94, 96. As illustrated, stripped group A resides on the top of the second 96. During interleaving, the group of cards A are deposited as a group at the top of the shuffled stack 16*a*. This shuffled stack 16*a* has, proximate its mid point, a group of previously interleaved group of cards B which, as before, will represent a group of cards to be stripped and transported during shuffling. At the shuffling station 32, the shuffled stack 16*a* is divided into unequal first and second portions 94, 96 with the group of cards B located on the top of the second portion 96. Group A resides on the top of the stack first portion 94.

As the cards are interleaved, group B is deposited on the top of now twice shuffled stack 16*b*. The previous group A has been interleaved with other cards, those previous cards of group A now included within a larger group A' of interleaved cards. With continued reference to FIG. 5, twice shuffled stack 16b includes proximate its mid point a group cards C to be stripped and transported. At the shuffling station 32, the twice shuffled stack 16b is cut into unequal first and second portions 94, 96. As illustrated, first portion 94 includes the previous stripped group of cards B as well as the interleaved and distributed group A' containing the originally stripped group of cards A. As the cards are interleaved and restacked into a shuffled stack 16c, the group of cards C, which has been twice interleaved, is transported and moved to the top of the stack 16c, the group of cards B has been interleaved with other cards as has the group of cards A prim. Thus the previous groups of B and A' are distributed among other cards in the stack as illustrated by B' and A".

As can be appreciated, repeating of the cutting and interleaving a plurality of times will result in a random and unpredictable distribution of cards in a shuffled stack.

While we have shown and described a preferred embodiment of the present invention, it is to be understood that it is subject to many modifications without departing from the spirit and scope of the claims. For example, the controller could randomly position the platform 22 to randomly vary the number of cards A stripped and transported, further enhancing the randomness and unpredictability of the distribution of cards. Further, the wheels, and particularly the pairs of wheels 48b could be randomly paused whereby two or more cards from the first portion 94 would be ejected into the chute on top of one another without any intervening cards being interleaved from the second portion 96. Thus the order of interleaving can also be randomly varied.

We claim:

1. A device for shuffling a stack of playing cards comprising:

a platform to support a stack of playing cards;

a cutting station;

translatable means at the cutting station for cutting and separating the stack into two unequal portions; and means for interleaving the cards from the separated portions into a shuffled stack.

2. The device of claim 1 wherein the platform is an elevator disposed in a vertical shaft.

3. The device of claim 2 including chambers to either side of the shaft to receive said portions.

4. The device of claim 2 wherein said interleaving means includes means for depositing cards from each portion into the shaft.

5. The device of claim 4 wherein the interleaving means is adapted for substantially depositing cards in alternating fashion from each said stack portions into the shaft.

6. The device of claim 5 wherein the interleaving means is a moveable tractive element disposed to contact the bottom card of each stack portion to move it from the stack portion.

7. The device of claim 6 wherein the tractive element is a rotatable wheel.

8. The device of claim 7 wherein the tractive element includes a pair of rotatable wheels.

9. The device of claim 7 wherein the wheel, relative to its axis, has an eccentric perimeter.

10. The device of claim 9 wherein the eccentric perimeter is adapted to engage a card during approximately one-half of the wheel's rotation.

11. The device of claim 1 wherein the cutting means is a sweep movable to cut and separate a stack into two unequal portions.

12. A device for shuffling cards comprising:

a vertical elevator shaft;

an elevator to support a stack of cards;

first and second chambers disposed to either side of the shaft;

means for moving the elevator to position the stack proximate said chambers;

a sweep translatable between a first and a second position to separate the stack into said chambers in unequal portions; and means for interleaving cards from each portion into the shaft.

13. The device of claim 12 including a control means for stopping the elevator at a first position and for controlling the sweep to move a stack portion to the first chamber and for moving the elevator to a second position and controlling the sweep to move remaining cards to the second chamber.

14. The device of claim 12 wherein the first and second chambers are proximate a top of the shaft and to either side thereof.

15. The device of claim 14 wherein each chamber includes a bottom adapted to support the stack portion deposited thereon.

16. The device of claim 15 wherein each chamber bottom declines from said shaft.

17. The device of claim 15 wherein the interleaving means includes means for pulling cards from the bottom of each stack portion and ejecting them into the shaft.

18. The device of claim 17 wherein the pulling means includes a moveable traction element.

19. The device of claim 18 wherein the traction element is a wheel.

20. The device of claim 19 wherein the wheel has a circumference with a coefficient of friction adapted to pull the cards.

21. The device of claim 19 wherein the wheel is disposed for eccentric rotation about an axis.

22. The device of claim 21 wherein the eccentricity of the wheel is adapted to contact the card for approximately one-half of the wheel's rotation.

23. The device of claim 12 further including means for imposing a load on each stack portion.

24. The device of claim 23 wherein the load imposing means for each portion includes an arm and means for pivotally mounting the arm, said arm pivoting to maintain contact with the top of the portion.

25. A device for shuffling cards comprising:

a shaft;

an elevator disposed in the shaft;

means for moving the elevator from a lowered position to a first and a second raised position;

first and second chambers disposed proximate the upper terminus of and to either side of the shaft;

translatable means for cutting the stack into unequal first and second portions and for depositing said first portion in said first chamber and the second portion in the second chamber; and means for depositing cards from said portions in interleaving fashion into said shaft.

26. The device of claim 25 wherein the depositing means deposits cards from said portions in interleaving fashion into said shaft onto the elevator.

27. The device of claim 25 including a controller to elevate and lower the elevator.

28. A method for shuffling a stack of cards comprising:

(i) providing a device having a housing including an elevator moveable in a shaft from an initial position to first and second positions and a chamber at either side of the shaft;

(ii) with the elevator at the initial position, placing the stack on the elevator;

(iii) moving the elevator from the initial position to the first position;

(iv) at the first elevator position urging a first portion of the card stack to one side into one chamber;

(v) moving the elevator to the second position;

(vi) at the second elevator position urging a second, remaining portion of the card stack to another side into the other chamber, said first and second portions containing a different number of cards; and (vii) interleaving the cards of the first and second portions in substantially alternating fashion into a shuffled stack.

29. The method of claim 28 including urging less than one half of the cards of the stack to one chamber and the remainder to the other chamber, the additional cards on the other chamber deposited as a group onto the shuffled stack.

30. The method of claim 28 including lowering the elevator and interleaving the cards into said shuffled stack onto to elevator.

31. The method of claim 28 including repeating the steps of (iii) through (vii) a plurality of times.

32. The method of claim 28 wherein the urging steps include translating a sweep from one side of the stack to push the first portion to said one side into one chamber and translating the sweep toward the other side to urge the remainder of the stack to the other side into the other chamber.

33. The method of claim 28 wherein the interleaving step includes driving a traction element at the bottom of each stack portion to pull the bottom card and transport it for interleaving.

34. The method of claim 33 wherein the driving step includes rotating a wheel.

35. The method of claim 33 wherein the rotating step includes rotating an eccentric wheel.

* * * * *